US011181343B2

(12) United States Patent
Ross

(10) Patent No.: US 11,181,343 B2
(45) Date of Patent: Nov. 23, 2021

(54) METHOD OF OPERATING DEPLOYABLE PROTECTION

(71) Applicant: Damian Ross, Saddle River, NJ (US)

(72) Inventor: Damian Ross, Saddle River, NJ (US)

( * ) Notice: Subject to any disclaimer, the term of this patent is extended or adjusted under 35 U.S.C. 154(b) by 0 days.

(21) Appl. No.: 17/106,443

(22) Filed: Nov. 30, 2020

(65) Prior Publication Data

US 2021/0088311 A1 Mar. 25, 2021

Related U.S. Application Data

(63) Continuation-in-part of application No. 16/038,394, filed on Jul. 18, 2018, now abandoned.

(51) Int. Cl.
*F41H 1/02* (2006.01)
*F41H 5/013* (2006.01)
*A45F 3/06* (2006.01)

(52) U.S. Cl.
CPC ..... *F41H 1/02* (2013.01); *A45F 3/06* (2013.01); *F41H 5/013* (2013.01)

(58) Field of Classification Search
CPC ..... F41H 1/02; F41H 5/013; A45F 3/06
USPC ..... 224/576
See application file for complete search history.

(56) References Cited

U.S. PATENT DOCUMENTS 5,797,140 A * 8/1998 Davis ..... F41H 1/02 2/2.5
6,161,738 A * 12/2000 Norris ..... A45C 9/00 109/49.5
6,419,132 B1 * 7/2002 Reed ..... A45C 15/00 109/49.5
6,685,071 B2 * 2/2004 Prather ..... A45C 15/00 2/2.5
9,351,557 B2 * 5/2016 Inouye ..... A45F 3/06
9,801,452 B2 * 10/2017 Duthoit ..... F41H 1/02
9,802,558 B2 * 10/2017 Namou ..... H02J 7/0063
10,188,197 B2 * 1/2019 Fraile Nuez ..... F41H 1/02
10,213,008 B2 * 2/2019 Weaver, Jr ..... A45F 3/06
2007/0262103 A1 * 11/2007 Blakley ..... A45B 11/02 224/190
2009/0014490 A1 * 1/2009 Bradley ..... A45C 13/008 224/576
2015/0196077 A1 * 7/2015 McIntire, Jr. ..... A41D 13/0518 2/2.5
2017/0332768 A1 * 11/2017 Fraile Nuez ..... A45F 3/06

* cited by examiner

*Primary Examiner* — Peter N Helvey

(57) ABSTRACT

A method of operating a deployable armor panel is disclosed with steps as; grasping a pair of extractors with a pair of handles or distal loops by inserting a thumb and/or finger of a user into said pairs of distal loops; extracting said deployable armor panel up and out by stretching said pair of extractors through said pair of distal loops connected therewith; stretching said deployable armor panel over head of said user by pulling said pair of extractors through said pair of distal loops from said internal compartment of said carrier; positioning said deployable armor panel in front of a chest of said user by draping said pair of tethers over said shoulders of said user; and securing said deployable armor panel in front of said chest by attaching said panel, to a belt disposed at both sides of said carrier, by a pair of adjustable fasteners.

13 Claims, 7 Drawing Sheets

METHOD OF OPERATING DEPLOYABLE PROTECTION

CROSS-REFERENCE TO RELATED PATENT APPLICATION

This application is a continuation-in-part of U.S. application Ser. No. 16/038,394, filed Jul. 18, 2018, which is incorporated by reference herein in its entirety.

FIELD OF INVENTION

The present invention generally relates to a field of mechanical engineering and particularly to the field of design armored technology. The present invention specifically relates to protective armor, and more specifically, to protective armor that can be deployed when needed from a concealed compartment.

BACKGROUND OF THE INVENTION

Known carriers such as backpacks typically employ a fabric shell having one or more compartments with upper openings that can be closed with a zipper, a flap snap, etc. These backpacks will have right and left shoulder straps that each connect between the top and the bottom of the fabric shell. Some backpacks may also have a waist belt (and/or chest belt) that buckles in front and is connected between the shoulder straps (or bands that connect the shoulder straps to the bottom of the fabric shell). Protective armor such as bulletproof vests are often worn by military or police personnel that may be entering dangerous situations. These vests can protect individuals from bullets, stab wounds, shrapnel, and the like. The degree of protection depends upon the type of armor employed in the vest. Where quick movements are needed in a tactical situation, soft, relatively flexible armor may be used. Where relatively lethal rounds are expected, the armor may be a hard and relatively thick ballistic plate designed to stop high caliber rounds or bullets from a high velocity rifle. The National Institute of Justice (NU) Standard-0101.06 regulates the benchmarks for what constitutes effective body armor. When discussing soft armor, this specification will be referring to armor that has some degree of flexibility, but will not necessarily be limited to the ND Standards.

When discussing soft armor, this specification will be referring to armor that has some degree of flexibility, but will not necessarily be limited to the ND Standards. When discussing ballistic plates, this specification will be referring to plates that are relatively thick and have a greater ability to stop bullets than soft armor, but will not necessarily be limited to the ND Standards. Bulletproof vests may be configured to protect the torso in front, and may also have sections to protect the back and the side areas in order to shield the vital organs of the wearer. The vests may also have devices for holding various implements (weapons, radios, etc.). A common holding system are the Modular Lightweight Load-carrying Equipment (M.O.L.L.E.) holders, which are typically a series of parallel fabric strips that are stitched at regular intervals to provide openings for holding various implements.

A number of researches have been done over ballistic shields or chest shields such as US20160003581A1 which discloses a plate carrier wearable by a user for housing an armor plate comprises a plurality of hinges that connect a front portion of the plate carrier and a back portion of the plate carrier at the bottom; and an attachment mechanism disposed near the top of the plate carrier and configured to adjustably secure the armor plate inside the plate carrier. Furthermore, U.S. Pat. No. 9,861,145B2 discloses a combination bag/vests which, in a bag configuration, serve as a functional bag and which, in a vest configuration, include a system for attaching one or more modular accessories to the vest in a desired configuration. The combination bag/vests wherein the vest configuration operates as a tactical personal body armor vest and the bag configuration conceals the tactical vest portion while permitting the one or more modular accessories to remain in the desired configuration. However, under such circumstances when some operations are needed, the extractions and putting on such armor shields take time and does not provide flexibility to a user and eventually leads to a fatal business.

The need for civilians to wear protective body armor has grown over the last decade. The problem with current solutions is that the user would either have to wear a bulletproof jacket vest or plate carrier which are cumbersome and inconvenient for every day civilian wear. The other option is to purchase a bulletproof backpack that only provides protection on the back of the user or, needs to be removed to convert it to allow front and back protection. Furthermore, the majority of bulletproof backpacks, vest and jackets only provide ND level 3A protection (against handguns). Our invention enables the user to use ballistic plates that can provide maximum protection against rifle fire. In undercover operations one may want to reveal that he or she is wearing protective armor. In these circumstances one may wish to conceal the protective armor and deploy in only when the situation becomes dangerous.

SUMMARY OF THE INVENTION

The present invention relates to a method of operating a deployable armor panel over a chest of a user by simply extracting said deployable panel from a compartment inside a carrier/bag-pack over shoulders of said user using two extractors with distal loops or handles on the end for the user to grasp and pull the front panel over the user's head and secure it firmly to the belt of the apparatus securing it in front of the user's chest.

In an embodiment the present invention discloses a method of operating a deployable armor panel. The method comprising steps: grasping a pair of extractors with a pair of distal loops by inserting a thumb and/or finger of a user into said pairs of distal loops, or handles wherein said pair of extractors comprises a proximal end attached to said deployable armor panel, wherein said deployable armor panel comprises a pair of tethers each with an anchored end secured inside an internal compartment of a carrier, wherein said carrier comprises a shell with an external pair of shoulder straps in order to mount said carrier over a shoulder of the user; extracting said deployable armor panel up and out by stretching said pair of extractors through said pair of distal loops connected therewith, wherein said pair of extractors are disposed in front of the shell and are configured to extent away from said internal compartment to a spaced pair in front of said shell along said pair of shoulder straps; stretching said deployable armor panel over head of said user by pulling said pair of extractors through said pair of distal loops or handles from said internal compartment of said carrier; positioning said deployable armor panel in front of a chest of said user by securing it to the belt of the apparatus with hook and loop fasteners and draping said pair of tethers over said shoulders of said user, wherein the pair of tethers are configured to allow said deployable armor panel to move from a position inside said internal compartment of the carrier to a position outside said internal compartment, wherein said pair of tethers are deployable to drape over both shoulders of said user and configured to suspended from said deployable armor panel anteriorly and thoracically; and securing said deployable armor panel in front of said chest by attaching said panel, to a belt disposed at both sides of said carrier with hook and loop fasteners, wherein said fasteners are disposed onto backside of said carrier.

In another embodiment the method further comprises securing, initially, each extractor from said pair of extractors to respective shoulder strap through said distal loops by the thumb and/or fingers or grasping a pair of handles disposed within said pair of distal loops.

To further clarify advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF FIGS

These and other features, aspects, and advantages of the present invention will become better understood when the following detailed description is read with reference to the accompanying following drawings in which like characters represent like parts throughout the drawings.

Figure 1:
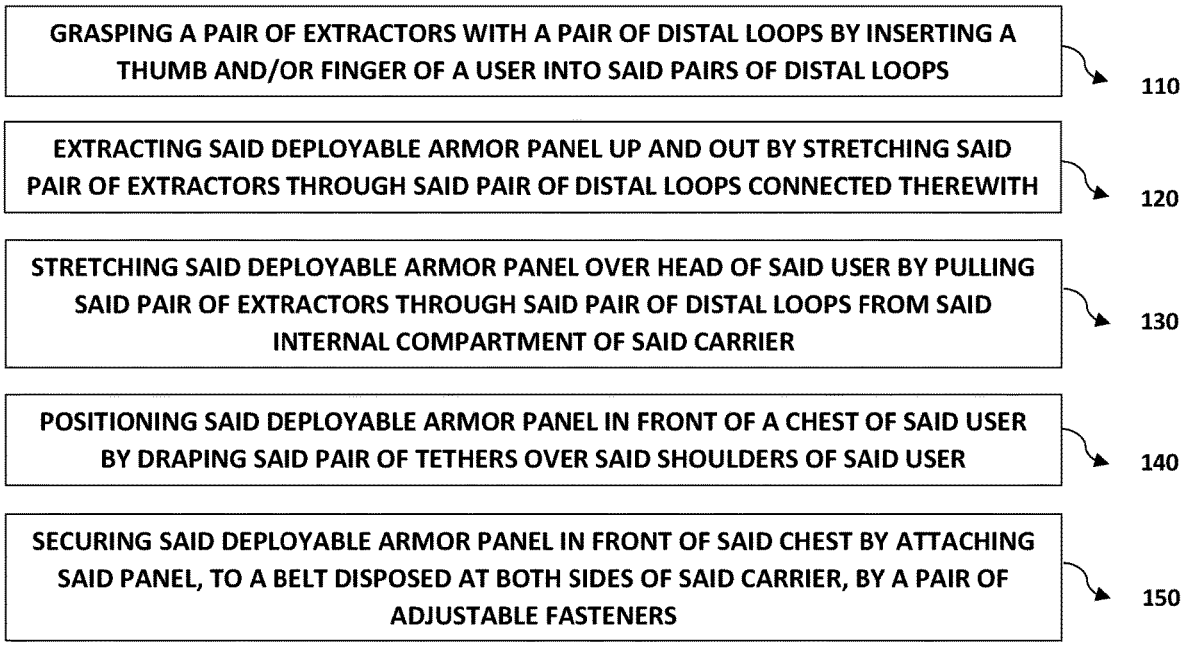
FIG. 1 illustrates a flow diagram of a method of operating a deployable armor panel in accordance with an embodiment of the present invention.

Further, skilled artisans will appreciate that elements in the drawings are illustrated for simplicity and may not have been necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates.

It will be understood by those skilled in the art that the foregoing general description and the following detailed description are exemplary and explanatory of the invention and are not intended to be restrictive thereof.

Reference throughout this specification to "an aspect", "another aspect" or similar language means that a particular feature, structure, or characteristic described in connection with the embodiment is included in at least one embodiment of the present invention. Thus, appearances of the phrase "in an embodiment", "in another embodiment" and similar language throughout this specification may, but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components.

Unless otherwise defined, all technical and scientific terms used herein have the same meaning as commonly understood by one of ordinary skill in the art to which this invention belongs. The system, methods, and examples provided herein are illustrative only and not intended to be limiting.

Embodiments of the present invention will be described below in detail with reference to the accompanying drawings.

Referring to FIG. 1 which illustrates a flow diagram of a method of operating a deployable armor panel in accordance with an embodiment of the present invention. The comprises steps mainly as follows:

Step (110) states grasping a pair of extractors with a pair of handles or distal loops by inserting a thumb and/or finger of a user into said pairs of distal loops, wherein said pair of extractors comprises a proximal end attached to said deployable armor panel, wherein said deployable armor panel comprises a pair of tethers each with an anchored end secured inside an internal compartment of a carrier, wherein said carrier comprises a shell with an external pair of shoulder straps in order to mount said carrier over a shoulder of the user.

Step (120) states extracting said deployable armor panel up and out by stretching said pair of extractors through said pair of handles or distal loops connected therewith, wherein said pair of extractors are disposed in front of the shell and are configured to extend away from said internal compartment to a spaced pair in front of said shell along said pair of shoulder straps. Step (130) involves stretching said deployable armor panel over head of said user by pulling said pair of extractors through said pair of handles or distal loops from said internal compartment of said carrier.

Step (140) states positioning said deployable armor panel in front of a chest of said user by draping said pair of tethers over said shoulders of said user, wherein the pair of tethers are configured to allow said deployable armor panel to move from a position inside said internal compartment of the carrier to a position outside said internal compartment, wherein said pair of tethers are deployable to drape over both shoulders of said user and configured to suspended from said deployable armor panel anteriorly and thoracically.

Step (150) states securing said deployable armor panel in front of said chest by attaching said panel, to a belt with hook and loop fasteners disposed at both sides of said carrier, by a pair of adjustable fasteners, wherein said adjustable fasteners are disposed onto backside of said carrier.

The method also includes securing, initially, each extractor from said pair of extractors to respective shoulder strap through said distal loops by the thumb and/or fingers or grasping a pair of handles disposed within said pair of distal loops. The method also states lifting, by peeling off, said pair of extractors from said pair of shoulder straps up and away from said chest before extracting said deployable armor panel in front of said chest of the user.

The method further comprises securing said deployable armor panel to the backside of said carrier around upper waist of user, by a plurality of adjustable fasteners, wherein said adjustable fasteners comprises a plurality of adjustable hook and loop fasteners disposed onto the backside of said carrier and coupled to said belt.

The present invention in an embodiment also describes securing said deployable armor panel to said carrier backside around upper waist of the user, by a plurality of magnetic elements attached to the back of the front plate carrier and oppositely charged magnetic elements are affixed to the belt of the apparatus.

The present invention in further embodiment states lacing adapted to be laced through said plurality of openings at said upper mouth of the internal compartment in order to releasably close the upper mouth, wherein said lacing comprises a pair of laces each having a proximal end separately connected to a respective one of said pair of extractors. Moreover, inserting a plurality of ballistic plates inside said deployable armor panel stacked one over another in a bundle, wherein said plurality of ballistic plates are configured to be resistant to explosives, stabbing, slashing and gunfire.

The present invention also states releasing said deployable armor panel from said adjustable fasteners coupled to said backside of said carrier by pulling off said adjustable fasteners through grasping said pair extractors by said thumb and/or fingers of said user. Also states closing the plurality of opening of said upper mouth by a plurality of releasable closure devices, wherein said devices comprise a plurality of magnetic elements for releasably closing said upper mouth, wherein said magnetic elements comprises a plurality of pairs of male and female connectors.

Figure 2:
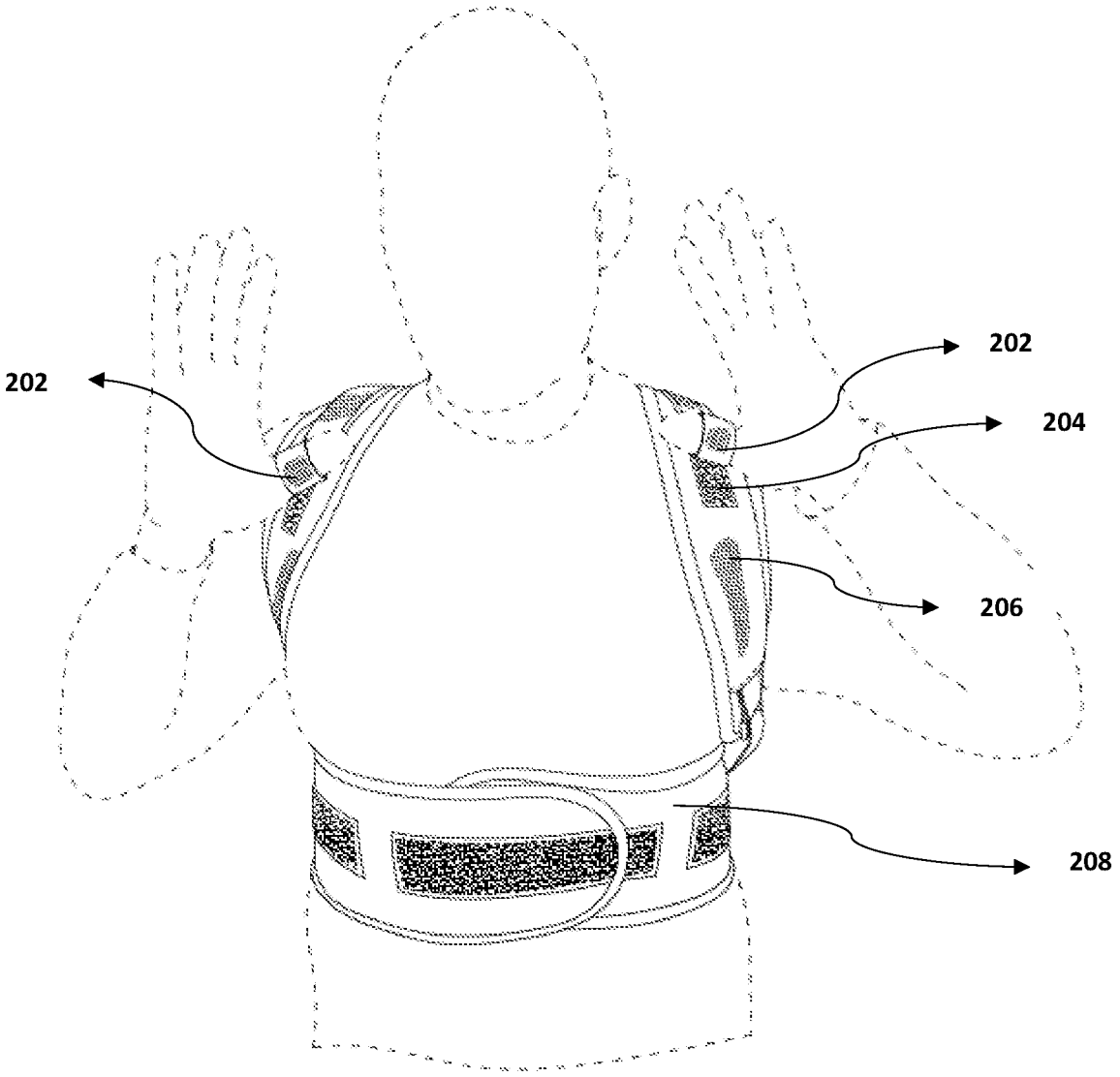
FIG. 2 illustrates a front view of user wearing said deployable armor panel inside a carrier or backpack in accordance with an embodiment of the present invention.

Referring to FIG. 2 which illustrates a front view of user wearing said deployable armor panel inside a carrier or backpack in accordance with an embodiment of the present invention. The user wearing said carrier or backpack over his/her shoulders with shoulder straps (206) and around his/her waist by a waist belt (208). The waist belt consists of two parts attached to lower part of the carrier. A first part of belt (208) is coupled over a second part by an adjustable fastener which can be hook or loop fasteners or any other suitable fasteners. The two distal loops (202) are provided over both shoulders and the user insert his/her thumbs or fingers into them and extracts the distal loops (202) from hook and loop fasteners (204) provided over shoulder straps (206).

Figure 3:
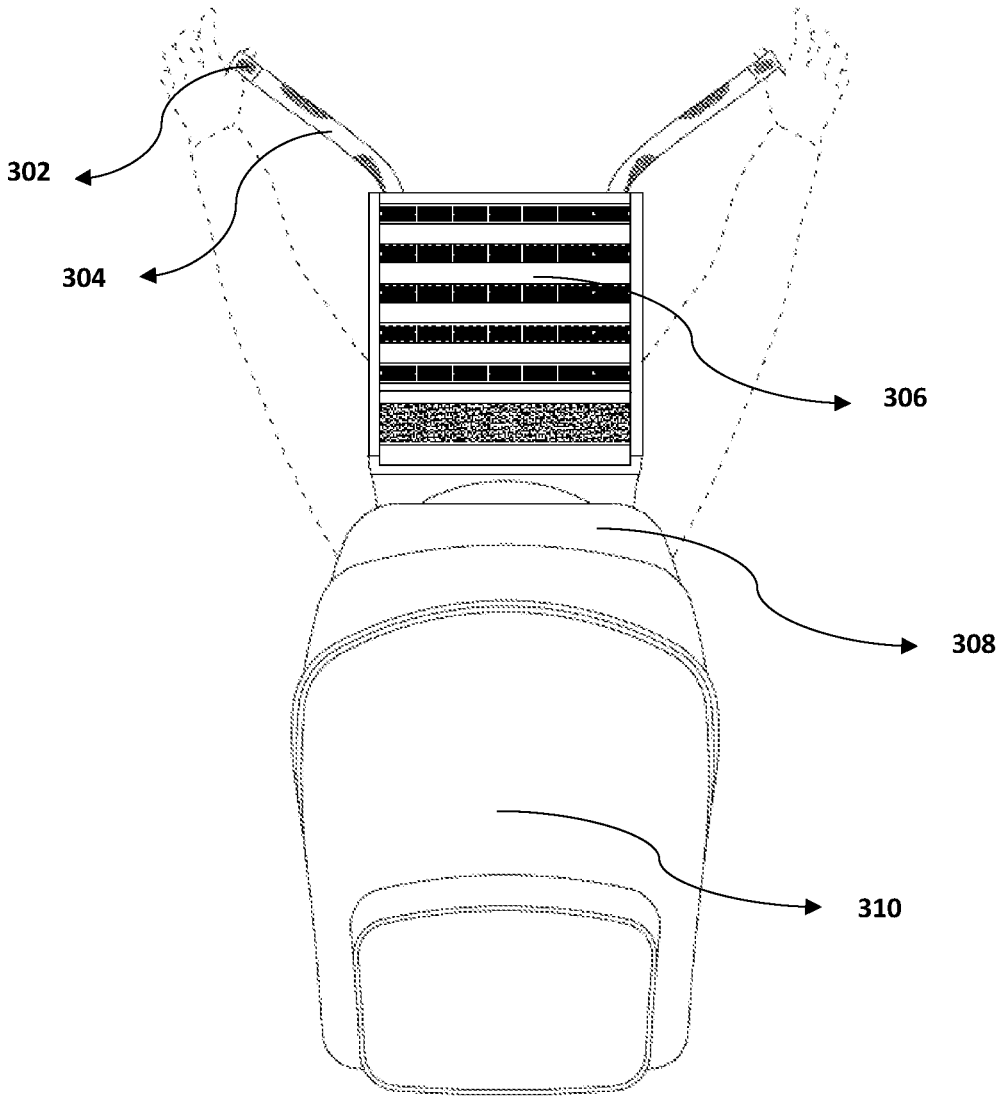
FIG. 3 illustrates a rear view of said user lifting or extracting said deployable armor panel from an inner compartment of said carrier in accordance with an embodiment of the present invention.

Referring to FIG. 3 which illustrates a rear view of said user lifting or extracting said deployable armor panel from an inner compartment of said carrier in accordance with an embodiment of the present invention. The user while extracting distal loops (302) of extractors (304) over shoulder straps (shown in FIG. 2), an armor panel (306) or chest panel or ballistic panel is configured to get extracted out of an inner compartment (308) of said carrier (310). The user just lifts said panel (306) by grasping extractors (304) through distal loops (302).

Figure 4:
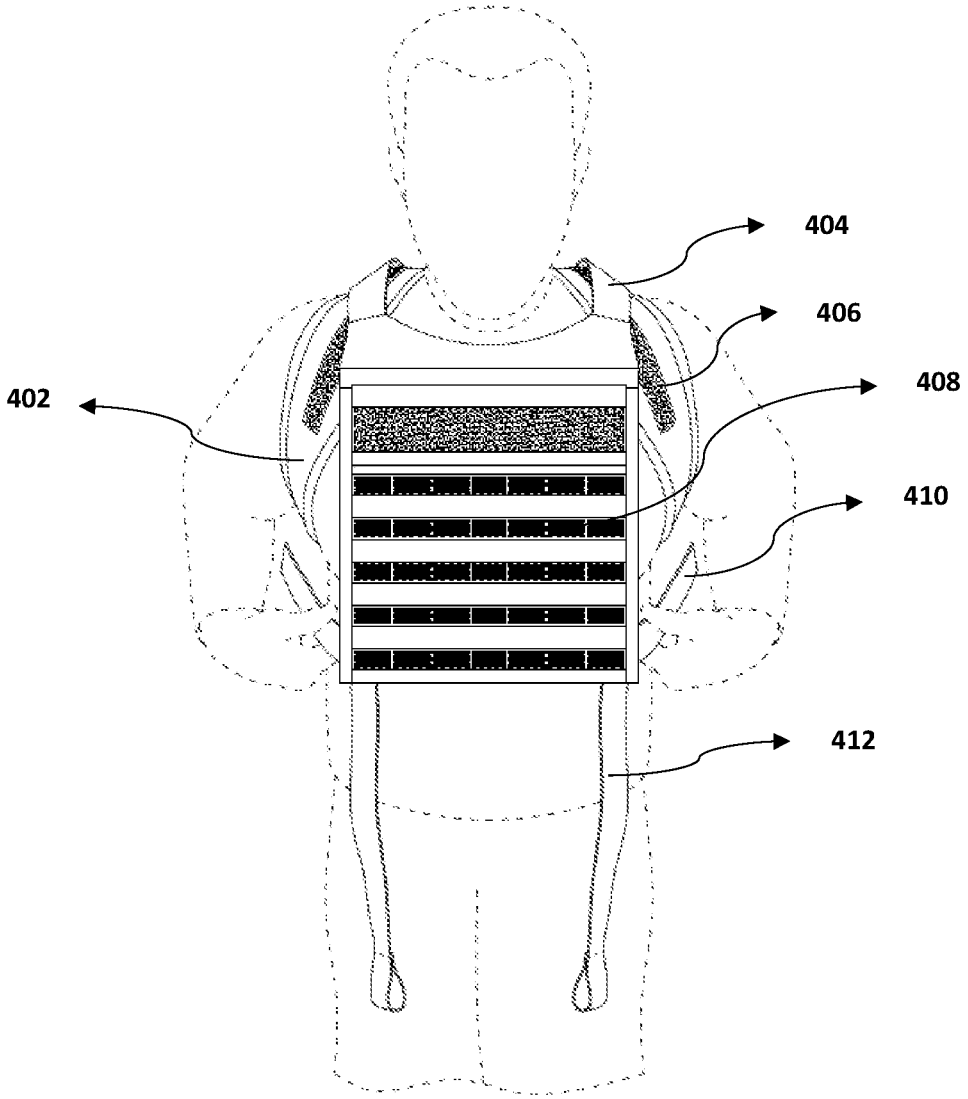
FIG. 4 illustrates a front deployed view of the user deploying said panel over chest in accordance with an embodiment of the present invention.

Referring to FIG. 4 which illustrates a front deployed view of the user deploying said panel over chest in accordance with an embodiment of the present invention. As illustrated the armor panel (408) is being deployed over his/her chest by the user. The armor panel (408) is connected to the inner compartment of the carrier through two straps (404). The extractors (412) hung downside the user when the panel (408) is lifted out from the inner compartment of said carrier and deployed over said chest of the user over shoulder straps (402). Two side straps (410) are provided at both sides of said panel (408) in order to connect the panel (408) to waist belt (as shown in FIG. 2) and to said carrier or backpack through adjustable hook and loop fasteners which are easily detached from the waist belt when an operation is over. The shoulder straps (402) are provided with hook and loop fasteners (406) in order to attached said extractors (412) when said panel (408) is detached from chest and back to the inner compartment of said carrier.

Figure 5:
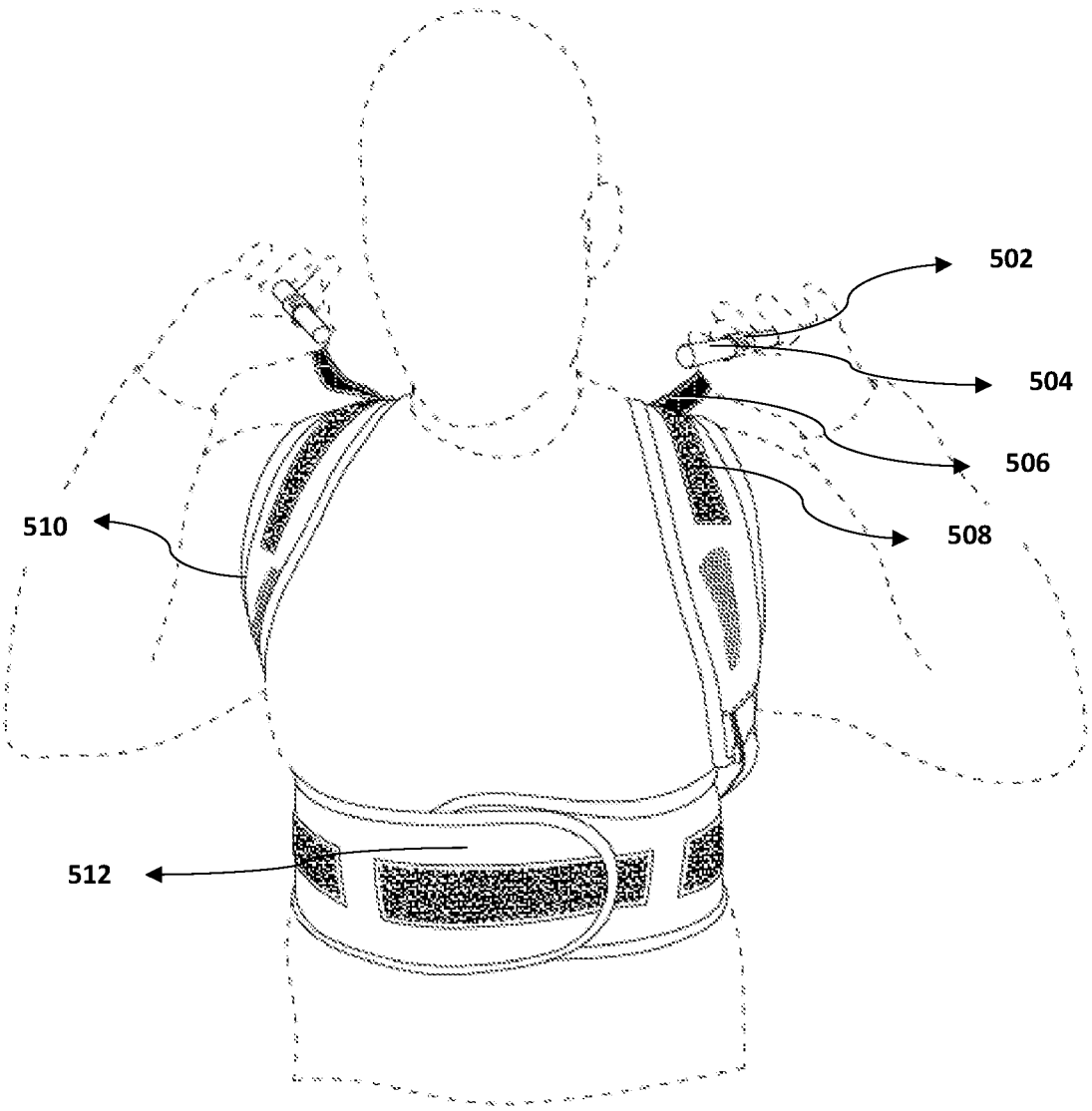
FIG. 5 illustrates a front view of user wearing said deployable armor panel inside the carrier or backpack with hands grasping handles inside distal loops in accordance with an embodiment of the present invention.

Referring to FIG. 5 which illustrates a front view of user wearing said deployable armor panel inside the carrier or backpack with hands grasping handles inside distal loops in accordance with an embodiment of the present invention. The user might sometimes get confused or in a situation wherein there is a need for chest shield, to insert his/her thumb or fingers inside distal loops (502) or can be time consuming, therefore the distal loops (502) of extractors (506) are provided with two handles (504) so that it can be easy for any user to just grasp both the handles and pull up the extractors from hook and loop fasteners (508) over the shoulder straps (510). The armor panel or shield is configured to be placed inside the carrier or backpack and is tightly wore by the user with the help of waist belt (512) attached to each other through some adjustable straps or hooks or hook and loop fasteners.

Figure 6:
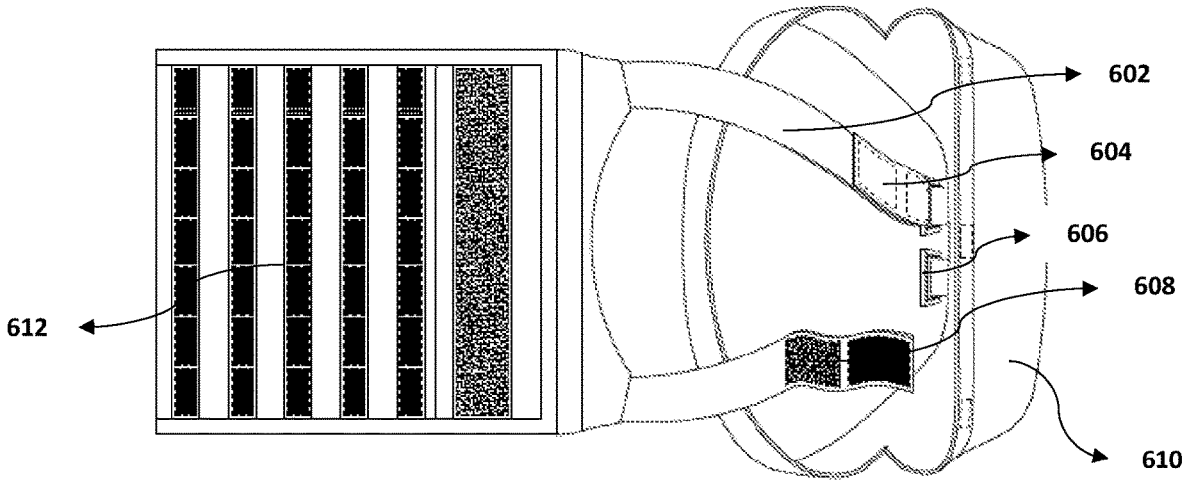
FIG. 6 illustrates a backpack or carrier inner compartment displaying attachments of said armor panel inside said compartment in accordance with an embodiment of the present invention.

Referring to FIG. 6 which illustrates a backpack or carrier inner compartment displaying attachments of said armor panel inside said compartment in accordance with an embodiment of the present invention. The armor panel (612) is configured to be placed inside an inner compartment (610) of a backpack or carrier. The panel (612) is connected to a top edge of inner compartment (610) through at least two straps (602) which is connected to a hook (606) attached to said edge of the compartment (610). The straps (602) are elastic in nature and can be employed to maintain balance when armor panel (612) is deployed over the chest of the user. The straps (602) are provided with hook and loop fasteners (608) in order to connect said panel (612) to the hook (606) of the compartment (610). The panel (612) can be detached completely from said compartment (610) of the carrier by detaching hook and loop fasteners (608) of the straps (602) from the hook (606) of the compartment (610).

Figure 7:
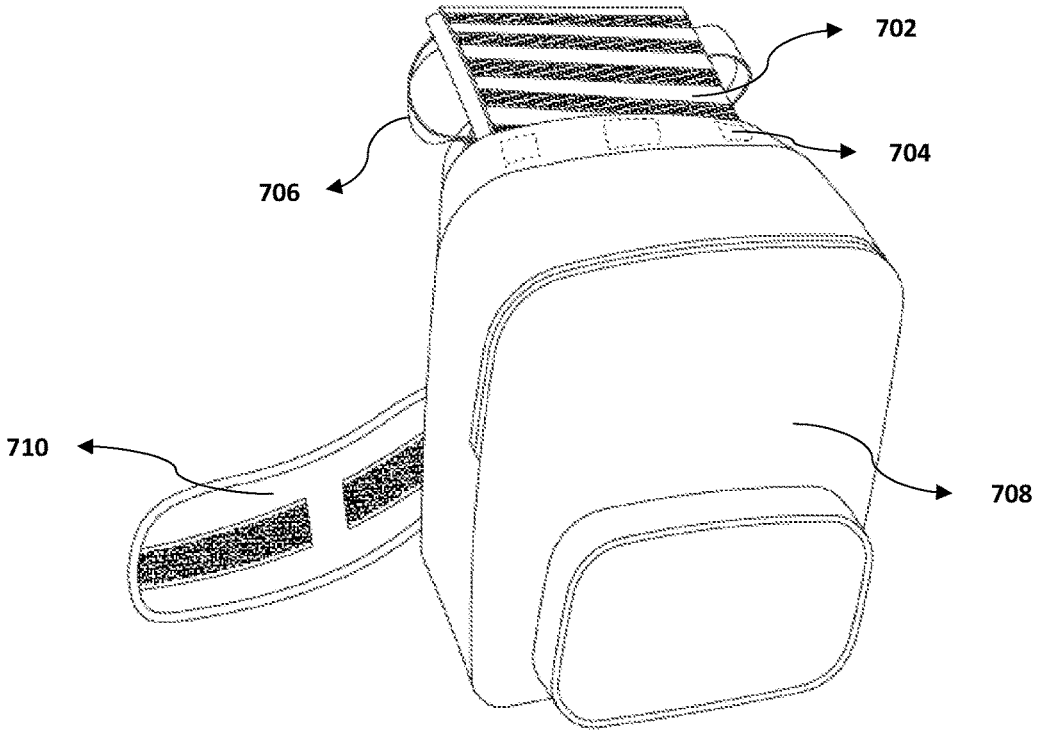
FIG. 7 illustrates an isometric view of said carrier or backpack displaying waist belt and armor panel being stored inside said inner compartment of said carrier in accordance with an embodiment of the present invention.

Referring to FIG. 7 which illustrates an isometric view of said carrier or backpack displaying waist belt and armor panel being stored inside said inner compartment of said carrier in accordance with an embodiment of the present invention. The armor panel (702) when detached from the chest of the user can be reinserted inside an inner compartment (708) of the backpack. The extractors (706) are placed outside the compartment when the panel (702) is being re-inserted inside the compartment (708). The compartment (708) is provided with a plurality of hook and loop fasteners or magnetic elements (704) over the top in order to close the mouth of said compartment (708). The backpack consists of waist belt (710) on both sides of said carrier. The belt (710) is provided with fasteners in order to adjust said carrier for the particular user.

Figure 8:
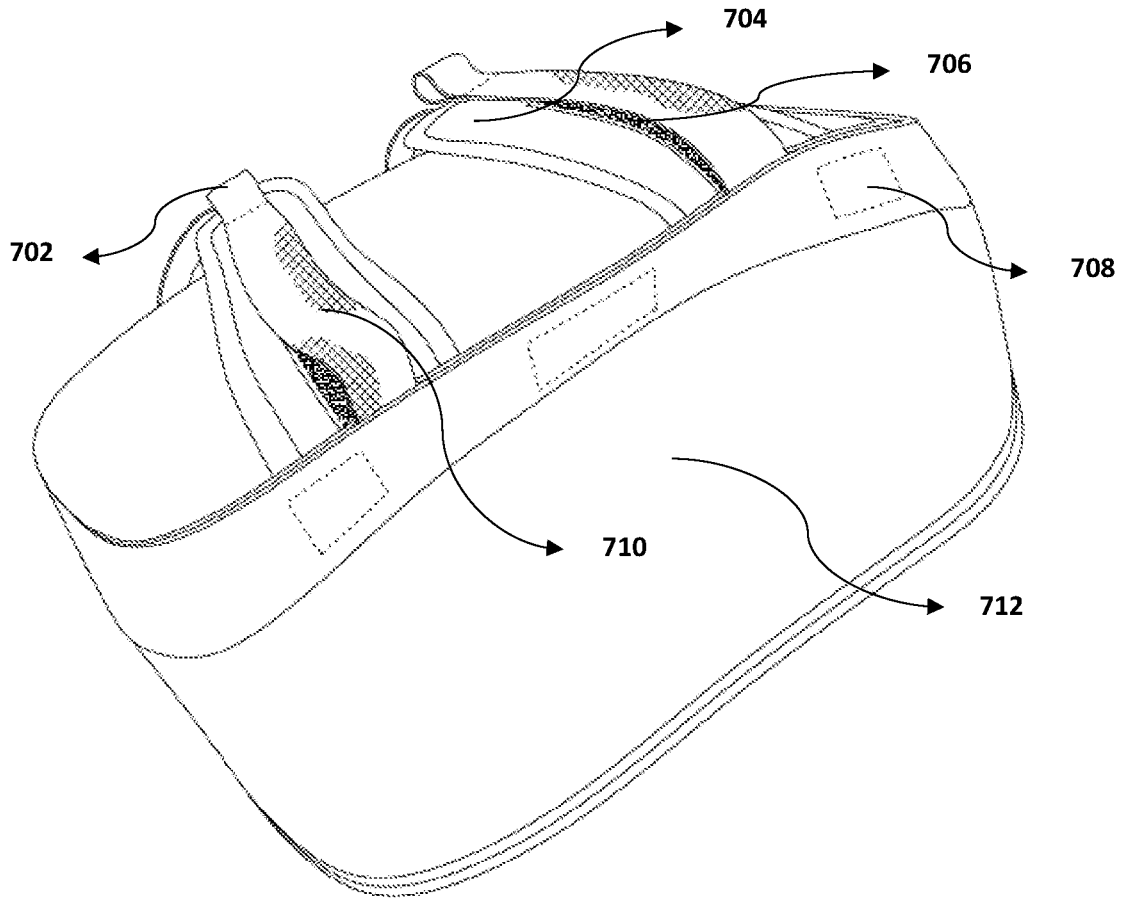
FIG. 8 illustrates a prospective view of said carrier or backpack displaying extractors with distal loops being attached to shoulder straps through hook and loop fasteners in accordance with an embodiment of the present invention.

Referring to FIG. 8 which illustrates a prospective view of said carrier or backpack displaying extractors with distal loops being attached to shoulder straps through hook and loop fasteners in accordance with an embodiment of the present invention. The panel (not shown) when re-inserted inside said compartment (712) after being detached from chest of the user, the two extractors (710) with distal loops (702) are placed or attached or coupled to the shoulder straps (704) with hook and loop fasteners (706). The mouth of the compartment (712) is closed by hook and loop fasteners (708) or magnetic elements.

Another embodiment of the present disclosure states embracing said user laterally by said deployable armor panel with an opposite pair of distally located flaps, wherein said armor panel comprises a pocket with a plurality of ballistic plates, wherein said armor panel is disposed within said internal compartment of said carrier and/or backpack, wherein said compartment comprises a floor with each end anchored through said pair of tethers being attached to said floor.

The closure devices are an alternate to those previously stated. In particular, the opposite edges of mouth correspond to the previously illustrated mouth. Alternate, releasable closure devices are shown as male connectors and female connectors. The male connector is a cylindrical knob extending past the edge of mouth and attached to the mouth by radial flange and the female connector is a split cylindrical sleeve extending past the edge of mouth and attached to the mouth by radial flange. The connectors are separated (front pair) and snapped together (rear pair). Initially, the male and female connectors are all snapped together to close mouth. An armored panel can be pulled up to pass through mouth and the passage of the panel will cause connectors to snap apart.

The closure devices are an alternate to those previously described. In particular, the opposite edges of mouth correspond to the previously illustrated mouth. The alternate, releasable closure devices are shown as a plurality of separate magnetic elements on the right edge of mouth and a plurality of separate magnetic elements on the left edge of mouth.

The magnetic elements are attached to the upper face of overhanging tab whose proximal portion is attached to mouth. Magnetic elements are attached to the lower face of overhanging tab whose proximal portion is attached to mouth. Magnetic elements are like rectangular slabs but can have different shapes in other embodiments. Magnetic elements can be described in separated and connected together. Initially, the magnetic elements are all connected together to close mouth. An armored panel can be pulled up to pass through mouth and the passage of the panel will cause the magnetic elements to snap apart.

The outer mouth is an alternate to the previously described. In this embodiment the edges of mouth partially overlap. This overlapping region is fitted with a complementary pair of hook and loop fastening strips. Accordingly, said mouth can be closed by pressing together fastening strips. An armored panel can be pulled up to pass through mouth and the passage of the panel will force hook and loop fastening strips apart to open mouth.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A method of operating a deployable armor panel, the method comprising steps:

grasping a pair of extractors with a pair of handles or distal loops by inserting a thumb and/or finger of a user into said pairs of distal loops, wherein said pair of extractors comprises a proximal end attached to said deployable armor panel, wherein said deployable armor panel comprises a pair of tethers each with an anchored end secured inside an internal compartment of a carrier, wherein said carrier comprises a shell with an external pair of shoulder straps in order to mount said carrier over a shoulder of the user;

extracting said deployable armor panel up and out by stretching said pair of extractors through said pair of distal loops connected therewith, wherein said pair of extractors are disposed in front of the shell and are configured to extent away from said internal compartment to a spaced pair in front of said shell along said pair of shoulder straps;

stretching said deployable armor panel over head of said user by pulling said pair of extractors through said pair of handles or distal loops from said internal compartment of said carrier;

positioning said deployable armor panel in front of a chest of said user by securing it to the fasteners on the belt and draping said pair of tethers over said shoulders of said user, wherein the pair of tethers are configured to allow said deployable armor panel to move from a position inside said internal compartment of the carrier to a position outside said internal compartment, wherein said pair of tethers are deployable to drape over both shoulders of said user and configured to suspended from said deployable armor panel anteriorly and thoracically; and securing said deployable armor panel in front of said chest by attaching said panel, to a belt disposed at both sides of said carrier, by a pair of adjustable fasteners, wherein said adjustable fasteners are disposed onto backside of said carrier.

2. The method as claimed in claim 1, wherein the method further comprises:

securing, initially, each extractor from said pair of extractors to respective shoulder strap through said distal loops by the thumb and/or fingers or grasping a pair of handles disposed within said pair of distal loops.

3. The method as claimed in claim 1, wherein the method further comprises:

lifting, by peeling off, said pair of extractors from said pair of shoulder straps up and away from said chest before extracting said deployable armor panel in front of said chest of the user.

4. The method as claimed in claim 1, wherein the method further comprises:

securing said deployable armor panel to the backside of said carrier around upper waist of user, by a plurality of adjustable fasteners, wherein said adjustable fasteners comprises a plurality of adjustable hook and loop fasteners disposed onto the backside of said carrier and coupled to said belt.

5. The method as claimed in claim 1, wherein the method further comprises:

securing said deployable armor panel to said carrier backside around upper waist of the user, by hook and loop fasteners or a plurality of magnetic elements to affix the front armor panel to protect the chest of the user.

6. The method as claimed in claim 1, wherein the method further comprises:

extracting said deployable armor panel by contemporaneously releasing a plurality of magnetic elements, wherein said magnetic elements are disposed within upper side and backside of said carrier, wherein said internal compartment of said carrier is configured to be opened and/or closed by said plurality of magnetic elements, wherein said compartment comprises an upper mouth with a plurality of openings to be opened and/or closed.

7. The method as claimed in claim 6, wherein the method further comprises:

a plurality of hook and loop fasteners configured at the opening of said upper mouth of the internal compartment in order to releasably close the upper mouth, wherein said the hook and loop closures will open an allow the front panel to be deployed when the extractors are activated.

8. The method as claimed in claim 6, wherein the method further comprises:

lacing adapted to be laced through said plurality of openings at said upper mouth of the internal compartment in order to releasably close the upper mouth, wherein said lacing comprises a pair of laces each having a proximal end separately connected to a respective one of said pair of extractors.

9. The method as claimed in claim 1, wherein the method further comprises:

inserting a plurality of ballistic plates inside said deployable armor panel stacked one over another in a bundle, wherein said plurality of ballistic plates are configured to be resistant to explosives stabs, spikes and gunfire.

10. The method as claimed in claim 1, wherein the method further comprises:

releasing said deployable armor panel from said adjustable fasteners coupled to said backside of said carrier by pulling off said adjustable fasteners through grasping said pair extractors by handles or distal loops with said thumb and/or fingers of said user.

11. The method as claimed in claim 6, wherein the method further comprises:

closing the plurality of opening of said upper mouth by a plurality of releasable closure devices, wherein said devices comprise a plurality of magnetic elements for releasably closing said upper mouth, wherein said magnetic elements comprises a plurality of pairs of male and female connectors.

12. The method as claimed in claim 1, wherein said method further comprises:

embracing said user laterally by said deployable armor panel with an opposite pair of distally located flaps, wherein said armor panel comprises a pocket with a plurality of ballistic plates, wherein said armor panel is disposed within said internal compartment of said carrier and/or backpack, wherein said compartment comprises a floor with each end anchored through said pair of tethers being attached to said floor.

13. The method as claimed in claim 1, wherein the method further comprises:

detaching said deployable armor panel from the belt disposed at both sides of said carrier, by extracting or pulling two side straps from hook and loop fasteners over said belt;

re-inserting said deployable armor panel into said inner compartment of said carrier or backpack and closing said inner compartment by a plurality of fasteners disposed over top edge of said inner compartment, wherein said extractors are configured to be kept out of said inner compartment; and attaching said extractors with distal loops over said shoulder straps through hook and loop fasteners disposed over said shoulder straps.

* * * * *